United States Patent [19]

Blackburn et al.

[11] Patent Number: 4,820,488

[45] Date of Patent: Apr. 11, 1989

[54] ALUMINUM ALLOY

[75] Inventors: Linda B. Blackburn, Hampton; Edgar A. Starke, Jr., Charlottesville, both of Va.

[73] Assignee: The United States of America as represented by the Administrator of the National Aeronautics and Space Administration, Washington, D.C.

[21] Appl. No.: 172,102

[22] Filed: Mar. 23, 1988

[51] Int. Cl.[4] ..... C22C 21/00

[52] U.S. Cl. ..... 420/529; 148/159; 148/416; 148/417; 420/533

[58] Field of Search ..... 420/529, 533; 148/416, 148/417, 438, 439, 159

[56] References Cited

U.S. PATENT DOCUMENTS 4,597,792 7/1986 Webster ..... 420/529

*Primary Examiner*—R. Dean

*Attorney, Agent, or Firm*—George F. Helfrich; John R. Manning; Charles E. B. Glenn

[57] ABSTRACT

At least about 0.1 percent by weight of indium is added as an essential component to an alloy which precipitates a $T_1$ phase ($Al_2CuLi$). This addition enhances the nucleation of the precipitate $T_1$ phase, producing a microstructure which provides excellent strength as indicated by Rockwell Hardness values and confirmed by standard tensile tests.

6 Claims, 1 Drawing Sheet

Al-2.3Cu-2.3Li-0.15Zr-x ALLOYS AGED AT 160°C

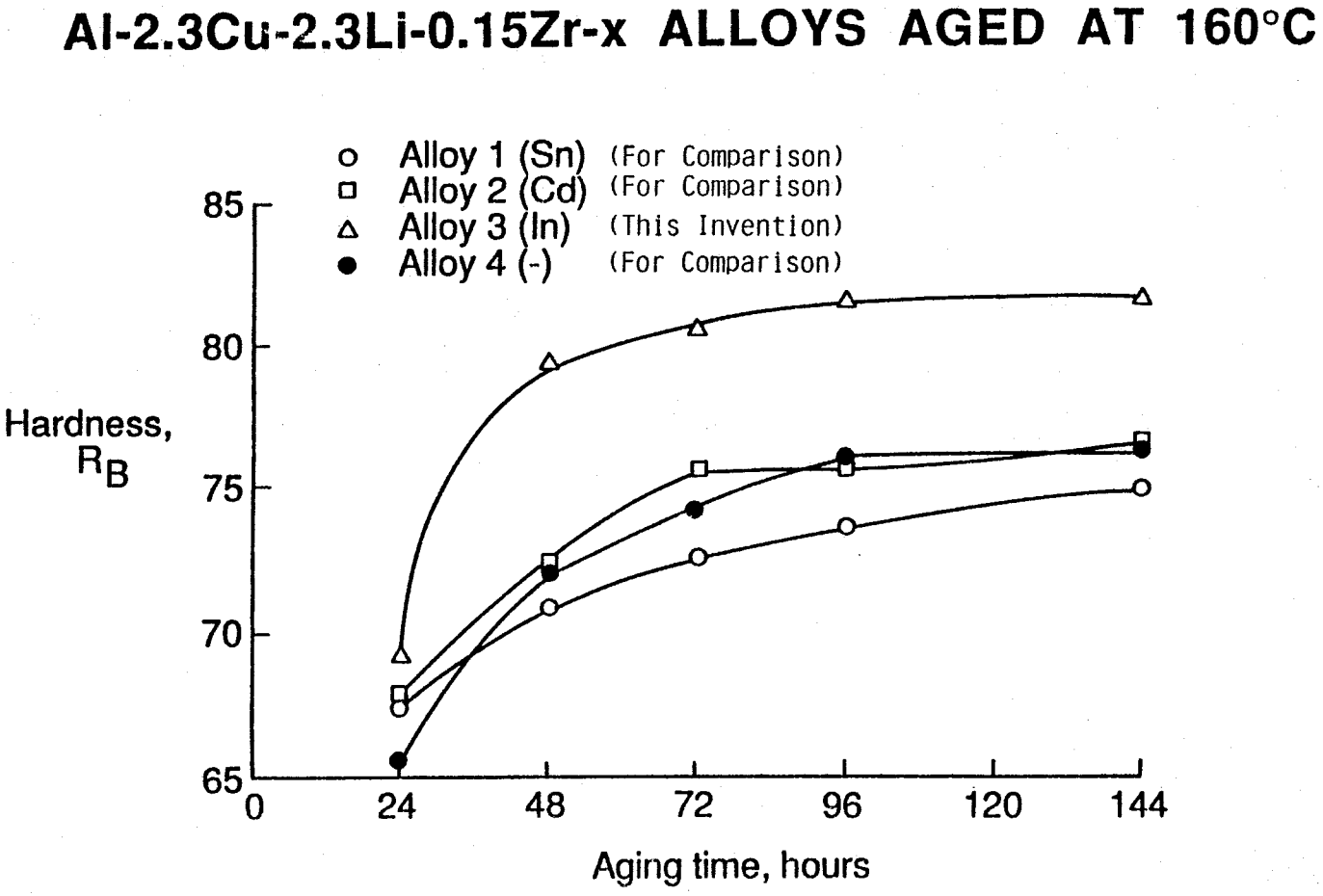
Al-2.3Cu-2.3Li-0.15Zr-x ALLOYS AGED AT 160°C
Alloy 1 (Sn) (For Comparison)
Alloy 2 (Cd) (For Comparison)
Alloy 3 (In) (This Invention)
Alloy 4 (-) (For Comparison)
Hardness, $R_B$
85
80
75
70
65
0
24
48
72
96
120
144
Aging time, hours

ALUMINUM ALLOY

ORIGIN OF THE INVENTION

The invention described herein was jointly made by an employee of the United States Government and an employee of the University of Virginia, and may be manufactured and used by or for the Government for governmental purposes without the payment of any royalties thereon or therefor.

FIELD OF THE INVENTION

This invention relates generally to aluminum alloys, and particularly to aluminum-copper-lithium alloys containing at least about 0.1 percent by weight of indium as an essential component, which alloys are suitable for applications in aircraft and aerospace vehicles.

DESCRIPTION OF THE PRIOR ART

There has been a longstanding need in the art for an alloy which combines low density with the ability to achieve high strength through heat treatment alone. Such an alloy would be highly suitable for processing to produce near-net shape parts, with applications of these parts in aircraft and aerospace vehicles.

It is known in the alloy art that the $T_1$ phase, viz., $Al_2CuLi$, is an alloy strengthening phase. However, it is not known or suggested in the art that the addition of indium to alloys which precipitate a $T_1$ phase enhances the nucleation of the precipitate $T_1$ phase, thereby producing a microstructure which provides strength after heat treatment alone, without the use of mechanical working.

Aluminum-copper-lithium alloys are well described in the art. See, e.g., U.S. Pat. No. 4,597,792. However, applicants know of no references which specifically disclose alloys of this type which also contain indium as an essential component and precipitate a $T_1$ phase. U.S. Pat. No. 3,607,413 does suggest that negative electrodes of lithium-aluminum alloys may have less than ten weight percent of impurities such as magnesium, manganese, copper, and indium. However, an aluminum-copper-lithium alloy having indium as an essential component is nowhere disclosed therein, and the properties and advantages of such an alloy are not comprehended or even remotely suggested. U.S. Pat. No. 4,471,031 does disclose an aluminum alloy containing indium, but the alloy disclosed does not contain copper as an essential component and does not precipitate a $T_1$ phase.

SUMMARY OF THE INVENTION

It is the primary object of the present invention to provide what is not available in the prior art, viz., an alloy which combines low density with the ability to achieve high strength through heat treatment alone, such an alloy being highly suitable for processing to produce near-net shape parts, with application of these parts in aircraft and aerospace vehicles.

This object is achieved by adding at least about 0.1 percent by weight of indium to an aluminum alloy which precipitates a $T_1$ phase ($Al_2CuLi$). The indium addition enhances the nucleation of the precipitate $T_1$ phase, thereby producing a microstructure which provides strength after heat treatment alone, without the use of mechanical working.

Very beneficial results are achieved when at least about 0.1 percent by weight of indium is added to an aluminum-copper-lithium alloy consisting essentially of the following components in the weight percent indicated: copper 2.0–3.0, e.g., 2.3; lithium 1.9–2.6, e.g., 2.3; zirconium 0.05–0.2, e.g., 0.15; the balance being aluminum, except for incidental impurities.

Aluminum alloys prepared according to the present invention have a significantly increased Rockwell Hardness, which is strongly indicative of enhanced strength characteristics. Tensile tests have completely verified this indication. These alloys are eminently suitable in processing which produces near-net shape parts (e.g., superplastic forming). Because of their low density, these alloys are ideally suited for applications in aircraft and aerospace vehicles.

BRIEF DESCRIPTION OF THE DRAWING

For a more complete understanding of the present invention, including its primary object and benefits, reference should be made to the Description of the Preferred Embodiments below. This Description should be read together with the accompanying drawing, which is a plot of Rockwell Hardness versus aging time for alloys according to the present invention as well as alloys presented for comparison.

DESCRIPTION OF THE PREFERRED EMBODIMENTS

Experimental alloys were provided having the compositions set forth in Table I below. The processing of these alloys included:

1. Casting of nominal 30 pound ingots;
2. Homogenizing by heat treating at 1010° F. for 24 hours;
3. Scalping; and
4. Hot rolling to nominal plates ½ inch thick and 8 inches wide, with length sufficient to produce a minimum weight of 15 pounds.

Chemical analyses were conducted, the results thereof being summarized in Table I.

TABLE I

| Alloy | Cu | Li | Zr | Mg | Fe | Other Components | Al |
|---|---|---|---|---|---|---|---|
| 1 (for comparison) | 2.3 | 2.3 | 0.15 | <0.01 | <0.08 | 0.15 Sn | Balance |
| 2 (for comparison) | 2.3 | 2.3 | 0.15 | <0.01 | <0.08 | 0.15 Cd | Balance |
| 3 (this invention) | 2.3 | 2.3 | 0.15 | <0.01 | <0.08 | 0.15 In | Balance |
| 4 (for comparison) | 2.3 | 2.3 | 0.15 | <0.01 | <0.08 | — | Balance |

Experimental alloys 1–4 were then aged according to the following procedure. The alloys were first heated to 560° C. ±3° C. for 30 minutes, followed by cold water quenching immediately upon removal from the furnace. Thereafter, the following aging schedules were effected without any delay:

A. Duplicate samples of each of the four experimental alloys were maintained at 160° C. ±3° C. for 24 hours.

B. Another set of duplicate samples of each of the four experimental alloys were maintained at 160° C. ±3° C. for 48 hours.

C. Yet another set of duplicate samples of each of the four experimental alloys were maintained at 160° C. ±3° C. for 72 hours.

D. Additional agings were effected for 96 and 144 hours, respectively, employing the procedures set forth in A–C above.

Rockwell Hardness values were obtained for each duplicate set of samples described above. These results were averaged and plotted against aging time, resulting in the curves found in the attached drawing. These curves are strongly indicative of superior strength characteristics of alloys according to the present invention.

In a separate series of experiments, triplicate samples of experimental alloys 1, 2, and 3 (see Table I above) were first solutionized at 560° C. for one-half hour, followed immediately by cold water quenching, then again at 160° C. ±3° C. for 72 hours. These samples were then subjected to standard tensile testing, the results of which are summarized in Table II below.

TABLE II

| Alloy Sample | UTS (ksi) | YS(ksi) | % Total Elongation |
|---|---|---|---|
| 1[c] - 1 | 67.99 | 62.38 | 6.2 |
| 1[c] - 2 | 68.68 | 58.36 | 10.7 |
| 1[c] - 3 | 69.30 | 60.33 | 6.3 |
| | 68.66 average | 60.36 average | 7.7 average |
| 2[c] - 1 | 66.05 | 54.16 | 8.7 |
| 2[c] - 2 | 66.70 | 56.31 | 9.6 |
| 2[c] - 3 | 67.25 | 58.14 | 6.1 |
| | 66.67 average | 56.20 average | 8.1 average |
| 3* - 1 | 79.00 | 69.82 | 10.3 |
| 3* - 2 | 78.52 | 70.31 | 9.5 |
| 3* - 3 | 77.65 | 72.25 | 4.9 |
| | 78.39 average | 70.79 average | 8.2 average |

*This invention
[c]Not this invention - for comparison

The tensile data of Table II confirm the superior strength characteristics of alloys according to the present invention as previously indicated by the Rockwell Hardness curves of the drawing.

In another separate series of experiments, samples of experimental alloys 2, 3, and 4 (see Table I above) were first solutionized at 560° C. for one-half hour, followed immediately by cold water quenching, then aging at 160° C. ±3° C. for 72 hours. By means of standard techniques well known to the skilled artisan, the $T_1$ phase precipitation was quantified for each sample in terms of $T_1$ number density (actual number per cubic micrometer). These data are set forth below in Table III.

TABLE III

| Alloy | $T_1$ number density, $\#/\mu m^3$ |
|---|---|
| 2 (for comparison) | 250 |
| 3 (this invention) | 1139 |
| 4 (for comparison) | 335 |

These data clearly show that a significantly enhanced nucleation of the $T_1$ phase has been brought about by the addition of at least about 0.1 percent by weight of indium to the baseline Al-Cu-Li alloy 4.

According to the present invention, the addition of at least about 0.1 percent by weight of indium to any baseline aluminum alloy which precipitates a $T_1$ phase should result in significantly enhanced nucleation of the $T_1$ phase. Additional indium may be introduced, if desired, up to the solid solution limit for indium in the alloy produced. Even more may be added, however, if desired benefits are obtained without the observance of deleterious effects, especially loss in tensile strength.

Produced is a microstructure which provides strength after heat treatment alone, without the need for mechanical working. Examples of other baseline aluminum alloys which are considered especially suitable for such an indium addition are: Alcoa 2090 - Cu: 2.4–3.0; Li: 1.9–2.6; Zr: 0.08–0.15; Alcoa 2091 - Cu: 1.8–2.5; Li: 1.7–2.3; Mg: 1.1–1.9; and the following alloy - Cu: 2.5–3.3; Li: 1.9–2.6; Mg: 0.2–0.8.

Although the present invention has been described in detail with respect to certain preferred embodiments thereof, it is understood by those of skill in the art that variations and modifications in this detail may be made without any departure from the spirit and scope of the present invention, as defined in the hereto-appended claims.

What is claimed is:

1. An aluminum-copper-lithium alloy which precipitates a $T_1$ phase and includes at least about 0.1 percent by weight of indium as an essential component.

2. An alloy according to claim 1, consisting essentially of, in weight percent:
copper: 2.0–3.0,
lithium: 1.9–2.6,
zirconium: 0.05–0.2,
indium: ≧0.1, and
aluminum: balance, except for incidental impurities.

3. An alloy according to claim 2, consisting essentially of, in weight percent:
copper: 2.3,
lithium: 2.3,
zirconium: 0.15,
indium: ≧0.1, and
aluminum: balance, except for incidental impurities.

4. A process for producing a low density aluminum-copper-lithium alloy having a microstructure which provides strength after standard heat treatment alone, without the use of mechanical working, which process comprises adding at least about 0.1 percent by weight of indium to a baseline aluminum-copper-lithium alloy which precipitates a $T_1$ phase.

5. The process of claim 4, wherein at least about 0.1 percent by weight of indium is added to a baseline aluminum-copper-lithium alloy consisting essentially of, in weight percent:
copper: 2.0–3.0,
lithium: 1.9–2.6,
zirconium: 0.05–0.2, and
aluminum: balance, except for incidental impurities.

6. The process of claim 5, wherein the baseline aluminum-copper-lithium alloy consists essentially of, in weight percent:
copper: 2.3,
lithium: 2.3,
zirconium: 0.15, and
aluminum: balance, except for incidental impurities.

* * * * *